US008935875B2

(12) United States Patent
Collin et al.

(10) Patent No.: US 8,935,875 B2
(45) Date of Patent: Jan. 20, 2015

(54) ARTICULATING MOUNT FOR WEAPON ACCESSORY

(71) Applicant: OptiFlow, Inc., Ann Arbor, MI (US)

(72) Inventors: Fred Collin, Brighton, MI (US); Mike Carlson, Saline, MI (US); Stephen Michael Shubeck, Ann Arbor, MI (US)

(73) Assignee: OptiFlow, Inc., Ann Arbor, MI (US)

( * ) Notice: Subject to any disclaimer, the term of this patent is extended or adjusted under 35 U.S.C. 154(b) by 114 days.

(21) Appl. No.: 13/656,194

(22) Filed: Oct. 19, 2012

(65) Prior Publication Data

US 2014/0137457 A1 May 22, 2014

Related U.S. Application Data

(60) Provisional application No. 61/558,252, filed on Nov. 10, 2011, provisional application No. 61/549,542, filed on Oct. 20, 2011.

(51) Int. Cl.
*F41A 15/00* (2006.01)
*F41G 11/00* (2006.01)

(52) U.S. Cl.
CPC ..... *F41G 11/003* (2013.01)
USPC ..... 42/90; 42/124; 42/128

(58) Field of Classification Search
CPC ..... F41G 11/003
USPC ..... 42/90, 124–128
See application file for complete search history.

(56) References Cited

U.S. PATENT DOCUMENTS

| | | | | | |
|---|---|---|---|---|---|
| 944,916 | A | | 12/1909 | Shepard | |
| 1,083,288 | A | | 1/1914 | Lowe | |
| 1,715,590 | A | | 6/1929 | Burhenne | |
| 2,115,618 | A | * | 4/1938 | Carl | 42/125 |
| 2,367,762 | A | | 1/1945 | Eiane | |
| 2,385,176 | A | | 9/1945 | White | |
| 2,425,130 | A | * | 8/1947 | Shelley | 42/16 |
| 2,445,087 | A | | 7/1948 | Rogers | |
| 2,451,266 | A | | 10/1948 | Whittemore | |
| 2,527,289 | A | | 10/1950 | Allen | |
| 2,529,801 | A | * | 11/1950 | Fisk | 42/128 |
| 2,545,419 | A | | 3/1951 | Williams | |
| 2,571,935 | A | * | 10/1951 | Pachmayr et al. | 42/128 |
| 2,597,466 | A | | 5/1952 | Felix | |
| 2,629,175 | A | * | 2/1953 | Merritt | 42/128 |
| 2,635,341 | A | | 4/1953 | Kruzell | |
| 2,639,507 | A | * | 5/1953 | Pachmayr | 42/128 |
| 2,644,237 | A | * | 7/1953 | Pachmayr | 42/128 |
| 2,710,453 | A | * | 6/1955 | Beverly | 42/128 |
| 2,773,310 | A | * | 12/1956 | Bircher | 42/136 |

(Continued)

FOREIGN PATENT DOCUMENTS

| | | |
|---|---|---|
| BE | 1029267 | 4/1958 |
| DE | 142545 C | 1/1902 |

(Continued)

*Primary Examiner* — Michelle R Clement
(74) *Attorney, Agent, or Firm* — Gifford, Krass, Sprinkle, Anderson & Citkowski, P.C.; Douglas L. Wathen

(57) ABSTRACT

A pivoting mount for a weapon accessory includes a base configured to attach to a weapon, an upper member, and a pivot shaft pivotally securing the upper member to the base. The upper member pivots between a use position and a storage position. The mount includes a first damping element disposed between the shaft and the base.

17 Claims, 4 Drawing Sheets

(56) References Cited

U.S. PATENT DOCUMENTS

| | | | | |
|---|---|---|---|---|
| 2,803,880 | A * | 8/1957 | Weaver | 42/128 |
| 2,914,287 | A | 11/1959 | Henning | |
| 3,178,823 | A * | 4/1965 | Lipski | 42/126 |
| 3,226,868 | A * | 1/1966 | Mahoney | 42/128 |
| 3,553,843 | A * | 1/1971 | Sophinos et al. | 42/138 |
| 3,559,940 | A | 2/1971 | Kruzell | |
| 3,732,642 | A | 5/1973 | Bray | |
| 4,092,793 | A * | 6/1978 | Ricks | 42/128 |
| 4,458,379 | A | 7/1984 | Shelton | |
| 4,461,087 | A * | 7/1984 | Norman | 42/128 |
| 4,659,130 | A | 4/1987 | Dimora et al. | |
| 5,165,178 | A | 11/1992 | Seely | |
| 5,442,860 | A * | 8/1995 | Palmer | 42/120 |
| 5,533,292 | A * | 7/1996 | Swan | 42/123 |
| 5,791,024 | A | 8/1998 | Jovanovich | |
| D485,644 | S | 1/2004 | Winn et al. | |
| 7,013,593 | B2 | 3/2006 | Pettersson et al. | |
| 7,076,907 | B2 * | 7/2006 | Nesseth et al. | 42/140 |
| 7,140,142 | B2 * | 11/2006 | Ballard | 42/118 |
| 7,181,882 | B2 * | 2/2007 | Woodbury | 42/137 |
| 7,356,962 | B2 * | 4/2008 | Swan | 42/147 |
| 7,367,152 | B2 * | 5/2008 | Samson | 42/128 |
| 7,369,302 | B2 * | 5/2008 | Gaber | 359/353 |
| 7,469,446 | B1 | 12/2008 | Brown et al. | |
| 7,552,558 | B1 * | 6/2009 | Ballard | 42/111 |
| 7,585,080 | B2 * | 9/2009 | Ballard | 359/511 |
| 7,730,655 | B2 * | 6/2010 | Spuhr | 42/127 |
| 7,908,782 | B1 * | 3/2011 | LaRue | 42/128 |
| 8,424,234 | B2 * | 4/2013 | Carlson et al. | 42/90 |
| 8,438,773 | B2 * | 5/2013 | Carlson et al. | 42/90 |
| 8,448,374 | B2 * | 5/2013 | Samson et al. | 42/138 |
| 8,510,983 | B2 * | 8/2013 | Larue | 42/148 |
| 8,572,881 | B2 * | 11/2013 | Samson et al. | 42/90 |
| 2007/0130817 | A1 * | 6/2007 | Ballard | 42/118 |
| 2007/0199227 | A1 * | 8/2007 | Ertl | 42/137 |
| 2008/0156341 | A1 | 7/2008 | Longoria et al. | |
| 2008/0186584 | A1 * | 8/2008 | Ballard | 359/611 |
| 2008/0276520 | A1 * | 11/2008 | Ballard | 42/143 |
| 2011/0099878 | A1 * | 5/2011 | Moody et al. | 42/90 |
| 2011/0146131 | A1 | 6/2011 | Ziegler | |
| 2011/0179690 | A1 | 7/2011 | Ziegler | |
| 2011/0192068 | A1 * | 8/2011 | Samson et al. | 42/90 |
| 2011/0296732 | A1 * | 12/2011 | Carlson et al. | 42/90 |
| 2012/0317860 | A1 * | 12/2012 | Langevin et al. | 42/111 |
| 2013/0055614 | A1 * | 3/2013 | Finnegan et al. | 42/90 |
| 2013/0160345 | A1 * | 6/2013 | Li et al. | 42/124 |
| 2013/0180155 | A1 * | 7/2013 | He et al. | 42/124 |
| 2013/0185985 | A1 * | 7/2013 | Ballard | 42/148 |
| 2014/0137457 | A1 * | 5/2014 | Collin et al. | 42/90 |

FOREIGN PATENT DOCUMENTS

| | | | |
|---|---|---|---|
| DE | 4306751 | C2 | 6/1995 |
| GB | 468237 | A | 7/1937 |

* cited by examiner

ARTICULATING MOUNT FOR WEAPON ACCESSORY

CROSS-REFERENCE TO RELATED APPLICATIONS

This patent application claims priority from U.S. provisional patent application Ser. No. 61/549,542, filed Oct. 20, 2011, and U.S. provisional patent application Ser. No. 61/558,252, filed Nov. 10, 2011, both of which are incorporated herein in their entirety.

FIELD OF THE INVENTION

An apparatus is disclosed herein for mounting accessories to a weapon.

BACKGROUND OF THE INVENTION

A weapon, such a rifle (a bow, crossbow or the like), is often used in combination with one or more accessories that may be mounted to the weapon. One such accessory is a sighting scope. There may also be accessories for the accessories, such as scope magnifiers or night vision devices. Where an accessory is in the nature of a sight, it may quite naturally be positioned along the "line-of-sight" (e.g., in line with the gun barrel) so that a user may better align the weapon with the intended target. In such cases it may also be desirable to quickly reposition the sight out of the line-of-sight. For example, if a scope magnifier is used in combination with a sighting scope, it may be desirable to allow the magnifier to be selectively moved from a use position (where it is aligned with the sighting scope) into an out of the way/inactive position (where it is not aligned with the sighting scope).

An early reference that disclosed an apparatus for repositioning an accessory in and out of a weapon's line-of-sight was German Patent No. 142545 (1903) to Polzin. In Polzin, an apparatus is described that allowed a rifle mounted scope to be automatically pivoted out of an active or line-of-sight position by the force of a clock spring.

Another reference, Great Britain Patent No. 468,237 to Taylor, disclosed a pivoting sight mount that could be biased into operational or deactivated positions by use of a spring-biased plunger "N" engaging detents on a pivot shaft "k".

In a still further reference, U.S. Pat. No. 2,385,176 to White, a pivoting sight mount was described that could be selectively retained in active or inactive positions by operation of a latch. The latch disclosed by White included a spring-biased pin that operated to engage recesses in a pivotable rod or shaft.

SUMMARY OF THE INVENTION

Disclosed herein are embodiments of a mount for repositioning an accessory on a weapon. The mount, for example, allows an accessory to be repositioned from a use or active position, in which the accessory may be aligned above the weapon, into an inactive or storage position in which the accessory may be moved to the side.

According to one embodiment, a pivoting mount for a weapon accessory includes a base configured to attach to a weapon, a pivot shaft, and an upper member. The base has a lower surface and an upper surface, the lower surface configured to engage the weapon. The base also has a fore support and an aft support, each having an aperture defined therethru. The apertures are aligned along a fore-aft pivot axis.

The pivot shaft engages the apertures in the supports of the base such that the pivot shaft extends along the pivot axis. The pivot shaft has an aft section engaging the aft support, a fore section engaging the fore support and a mid section defined therebetween. The aft section of the pivot shaft has at least two detents defined therein.

The upper member is pivotally secured to the base by the pivot shaft. The upper member has an upper surface for receiving an accessory and an opposed lower surface. The upper member pivots around the pivot axis between a use position wherein the lower surface of the upper member is adjacent the upper surface of the base and a storage position wherein the lower surface of the upper member is pivoted away from the upper surface of the base. The upper member has a pivot portion with an aperture defined therethru, the aperture receiving the mid section of the pivot shaft.

A first damping element is disposed between the shaft and the base. The first damping element is an elastomeric ring disposed in the fore aperture of the base and surrounds the fore section of the pivot shaft.

A second damping element is disposed between the upper member and the base. The second damping element is an elastomeric ring disposed between the pivot portion and one of the supports.

A retaining assembly selectively retains the upper member in at least the use and storage positions with respect to the base. The retaining assembly includes a spring loaded ball engaging the detents in the aft section of the pivot shaft when the upper portion is in the use and storage positions.

The base may include a quick release clamping mechanism operable to engage a rail of a weapon, the mechanism defining the lower surface of the base.

In some versions, the first damping element includes two elastomeric rings disposed in the fore aperture of the base and surrounding the fore section of the pivot shaft and a spacer disposed between the two elastomeric rings.

In certain versions, the second damping element includes two elastomeric rings. One of the rings is disposed between the fore support and the pivot portion and the other is disposed between the aft support and the pivot portion. Each of the rings being disposed around the pivot shaft.

The base may have a recess defined therein, extending from the aperture in the aft support. The spring loaded ball may be disposed in the recess.

In some versions, the pivot shaft fixedly engages the pivot portion of the upper member such that the upper member and pivot shaft rotate together.

The pivot portion of the upper member may include a stop flange that engages the base when the upper member is in the storage position.

In another embodiment of the present invention, a pivoting mount for a weapon accessory includes a base configured to attach to a weapon, an upper member, a pivot shaft pivotally securing the upper member to the base such that the upper member pivots between a use position and a storage position, and a first damping element disposed between the shaft and the base.

DETAILED DESCRIPTION OF THE INVENTION

The present invention provides a pivoting mount for mounting an accessory to a weapon. Typically, such a weapon has a mounting rail running along an upper surface of the weapon. A mount in accordance with the present invention may be mounted to this rail using any of a variety of mounting structures. In some embodiments, the present invention uses a quick release mounting structure as described in co-pending U.S. patent application Ser. No. 12/819,506, the entire contents of which is incorporated herein by reference.

The mount attaches to the weapon and is designed to support an accessory thereon. Alternatively, an accessory may have a mount in accordance with the present invention integrated therewith, rather than the accessory being detachably interconnected with the mount. In such a case, the accessory is part of the upper member of the mount.

The mount allows an accessory to be pivoted between a use position and a storage position. For example, a magnifier for a citing device for a scope may be pivoted between a use position wherein it is aligned with the sighting device and a storage position wherein it is not aligned with a storage device.

The Figures included herewith are accurately scaled for some embodiments, and may be used to determine relative dimensions. Other embodiments may be configured differently and have different relative dimensions.

Figure 5:
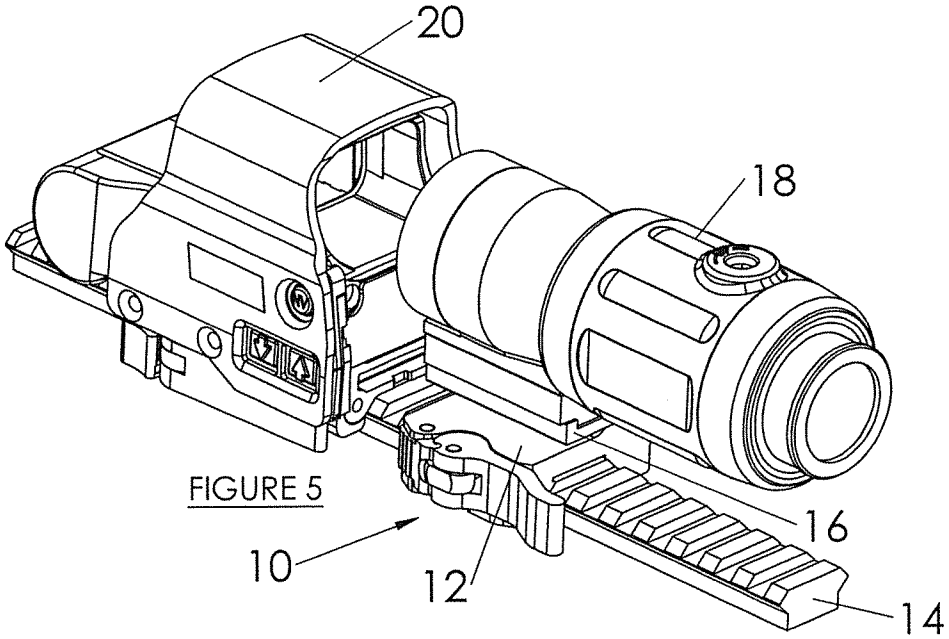
FIG. 5 is a perspective view showing the mount of FIG. 1 positioned on a weapon rail proximate a sight and having a scope magnifier on the upper member in the use position.
Figure 6:
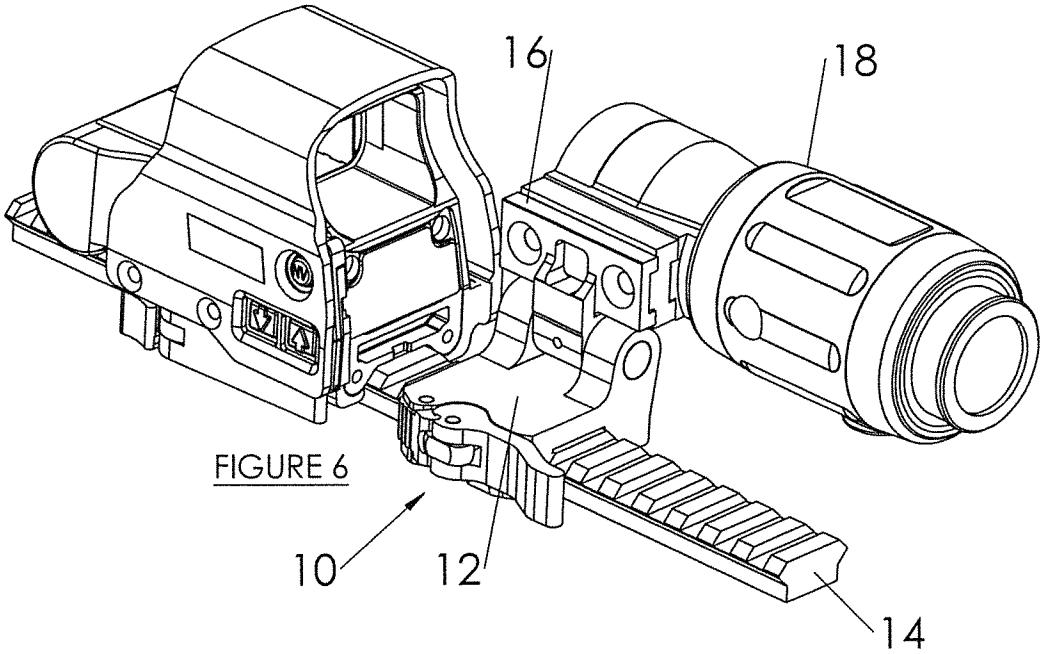
FIG. 6 is a perspective view of the mount and accessory of FIG. 5, with the mount and accessory in a storage position.

Referring to FIGS. 5 and 6, a mount in accordance with an embodiment of the present invention is generally shown at 10. The mount includes a base 12, which is shown clamped to the rail 14 which may be attached to or form part of a weapon, not shown. The mount further includes an upper member 16 that is pivotally interconnected with the base 12. An accessory, such as magnifier 18, may be attached to the upper member 16. FIG. 5 shows the accessory 18 in a use position, wherein it is aligned with a sighting device 20. FIG. 6 illustrates the accessory 18 moved to a storage position. The upper member 16 is pivoted with respect to the base 12 to a storage position. As shown, the mount is a single pivot design, which makes it simple and robust.

Figure 1:
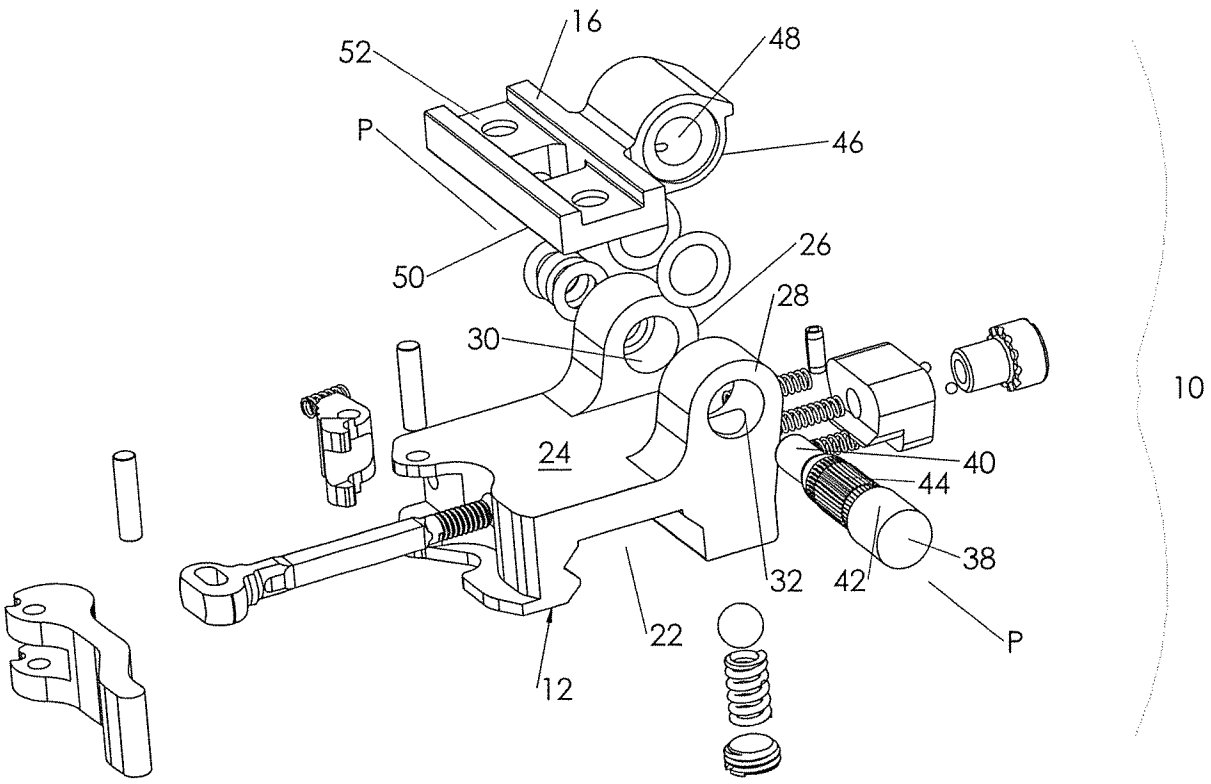
FIG. 1 is an exploded perspective view of an embodiment of an pivoting mount for a weapon accessory in accordance of the present invention.

Referring now to FIG. 1, an embodiment of a pivoting mount in accordance with the present invention will be described in more detail. The base 12 has a lower surface 22 configured to engage a weapon. In the illustrated embodiment, the base includes a quick release clamping mechanism, as described in detail in co-pending patent application Ser. No. 12/819,506. This mechanism defines the lower surface of the base. Alternatively, the base may have other types of mechanisms for attaching to a weapon or rail, or may interconnect with an independent clamping mechanism. The base 12 has an upper surface 24 opposite the lower surface 22. A pair of supports, 26 and 28, extend upwardly from the upper surface 24. The supports may be referred to as a fore support 26 and an aft support 28. Each has an aperture 30 and 32, respectively, defined therethru. These apertures 30 and 32 are aligned along the fore-aft pivot axis P.

A pivot shaft 38 engages the apertures 30 and 32 such that the pivot shaft extends along the pivot axis P. The pivot shaft can be said to have a fore section 40 that engages the aperture 30 in the fore support 26 and an aft section 42 that engages the aperture 32 in the aft support 28 when the mount is assembled. The pivot shaft also has a mid section 44 disposed between the fore section 40 and aft section 42.

The upper member 16 has a pivot portion 46 with a fore-aft aperture 48 defined therethru. The aperture 48 receives the mid section 44 of the pivot shaft 38. In the illustrated embodiment, the mid section 44 has teeth thereon such that it fixedly engages the aperture 48 and the upper member 16 and pivot shaft 38 rotate as a unit.

The upper member 16 may be said to have a lower surface 50 and an opposed upper surface 52. An accessory may be mounted to the upper surface 52, or the accessory may be integral with the upper member 16. When the upper member 16 is in the use position, the lower surface 50 is adjacent the upper surface 24 of the base 12. This position is shown in FIG. 5. When the upper member 16 is in the storage position, the lower surface 50 is pivoted away from the upper surface 24 of the base 12, as shown in FIG. 6.

Figure 4:
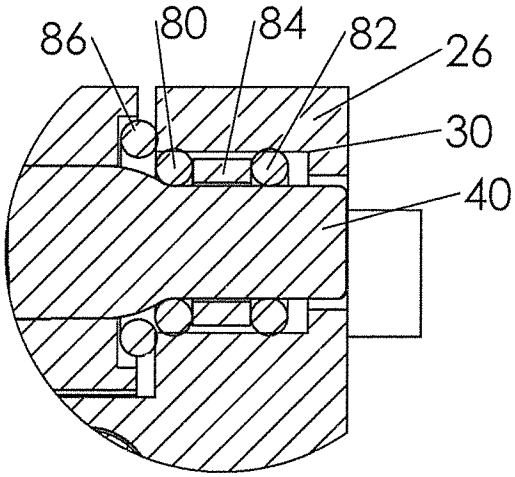
FIG. 4 is a detail view of the portion of FIG. 3 indicated at A.
Figure 3:
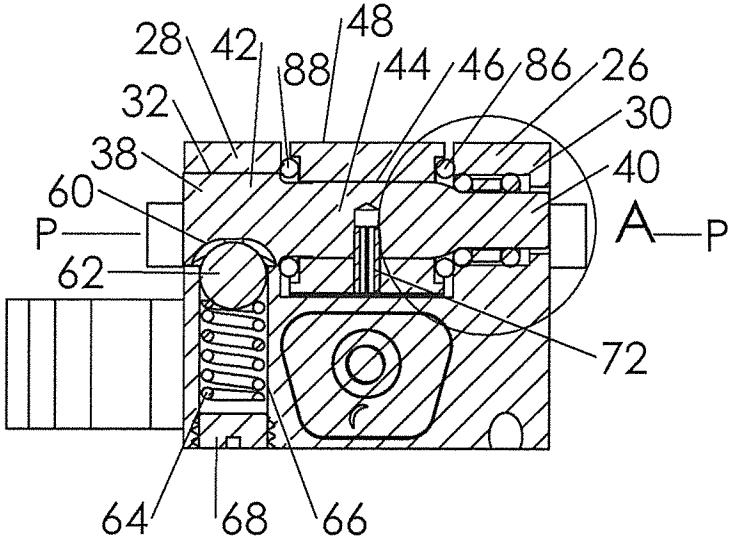
FIG. 3 is planar side cut-away view of the mount of FIG. 1 taken along line A-A of FIG. 2.
Figure 2:
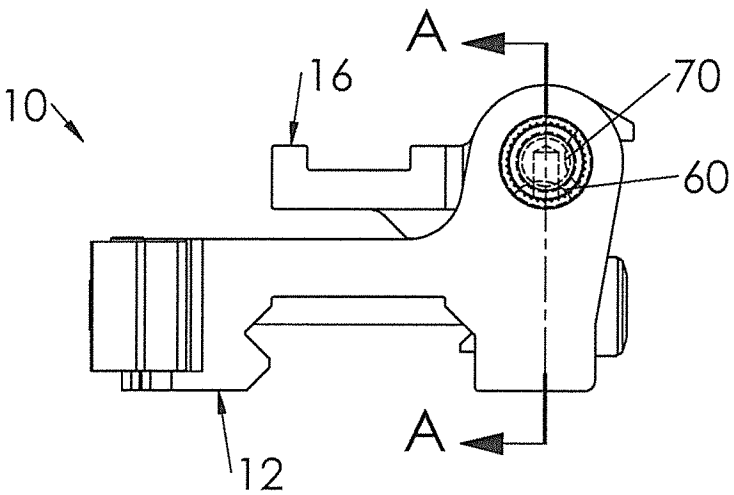
FIG. 2 is a planar side view of the mount of FIG. 1.

Referring now to FIGS. 2-4, details of an embodiment of the present invention will be discussed. As shown, the pivot shaft 38 has an aft section 42 that is received in the aperture 32 in the aft support 28 with very limited clearance, so as to provide pivoting only about the pivot axis P. In this embodiment, the aft section 42 has at least one detent 60 defined therein. A ball 62 engages in the detent 60 when the upper member 16 is in the use position. The ball 62 is biased into the detent by a spring 64. The ball and spring are both received in a recess 66 in the base 12 that extends from the aperture 32 in the support 28. In the illustrated embodiment, the recess 66 is a drilled hole with its bottom end closed off by a threaded closure member 68. The ball 62, spring 64, and detent 60 together faun a retaining assembly that is operable to selectively retain the upper member in the use position. The upper member 16 remains in the use position until sufficient pivotal force is applied to the upper member to overcome the retaining force of the retaining assembly and push the ball 62 downwardly in the recess 66. The upper member 16 may be then rotated to the storage position. Preferably, an additional detent 70 is provided in the aft section 42 of the pivot shaft 38 and positioned so as to retain the upper member in the storage position. Additional intermediate detents may also be provided. Other configurations for a retaining assembly may be used, or a retaining assembly may be omitted in certain embodiments. In some embodiments, a retaining assembly is the only portion of the mount that holds the upper member in the use and/or storage position, and there is no biasing element to bias the upper member toward either position. Instead, the upper member is moved from one position to the other by the user. Alternatively, a biasing element may be provided in other embodiments.

As mentioned above, the mid section 44 of the pivot shaft 38 is received in the pivot portion 46 of the upper member 16. In some embodiments, the pivot portion 48 and the mid portion 44 are rigidly interconnected. As shown in FIG. 3, a roll pin 72 may be used as part of this rigid interconnection.

As best shown in FIGS. 3 and 4, the aperture 30 in the fore support 26 may be stepped with a larger diameter portion and a smaller diameter portion. The larger diameter portion has a diameter larger than the outer diameter of the fore section 40 of the pivot shaft leaving a space to receive a first damping element. In the illustrated embodiment, this first damping element takes the form of a pair of elastomeric rings 80 and 82 that are spaced apart and held in a spaced apart arrangement by a spacer ring 84. In some embodiments, the elastomeric rings are formed of polyurethane with a durometer of 90D, and the spacer ring is formed of stainless steel. This first damping element provides vibration or shock damping between the shaft 38 and the base 12 during recoil of the weapon.

As best shown in FIG. 3, the mount 10 may also include a second damping element that is disposed between the upper member and the base. In the illustrated embodiment, this takes the form of a pair of elastomeric rings 86 and 88. These rings each surround the pivot shaft 38, with one ring being disposed between the fore support 26 and the pivot portion 48 and the other being received between the aft support 28 and the pivot portion 48. In some embodiments, these elastomeric rings are formed of polyurethane and have a durometer of 70D. The second damping element provides vibration or shock damping between the upper portion and base during recoil.

As will be clear to those of skill in the art, the damping elements may take other forms, such as only a single ring for each damping element and/or damping elements with a different shape. Preferably, the damping elements provide damping of the substantial forces experienced by the mount during firing of a weapon to which the mount is attached. These forces may include twisting forces on the upper member relative to the base. Preferably, the tolerances are such that there is no linear movement of the shaft relative to the base.

While the first damping element is illustrated as being disposed in the fore support 26 and the retaining assembly is shown engaging the aft portion 42 of the shaft, in further embodiments, these features may be reversed with the damping being in the aft section and the retaining assembly being in the fore section. As a further alternative, additional damping may be provided at the aft section, either with or without the retaining assembly. In further embodiments, other retaining assemblies may be used. Additionally, various types of latches may be provided for further locking the upper member in either the use or storage positions.

While the mount is illustrated with the fore and aft supports as part of the base and the pivot portion as part of the upper member, this configuration may be reversed in some embodiments. The pivot portion may also be referred to as a mid support.

As will be clear to those of skill in the art, the herein illustrated and discussed embodiments may be altered in various ways without departing from the scope or teaching of the instant disclosure. It is the following claims, including all equivalents, which define the scope of the invention.

We claim:

1. A pivoting mount for a weapon accessory, comprising a base configured to attach to a weapon, the base having a lower surface and an upper surface, the lower surface configured to engage the weapon, the base having a fore support and an aft support, the supports each having an aperture defined therethru, the apertures being aligned along a fore-aft pivot axis;

a pivot shaft engaging the apertures in the supports of the base such that the pivot shaft extends along the pivot axis, the pivot shaft having an aft section engaging the aft support, a fore section engaging the fore support and a mid section defined therebetween, the aft section of the pivot shaft having at least two detents defined therein;

an upper member pivotally secured to the base by the pivot shaft, the upper member having an upper surface for receiving an accessory and an opposed lower surface, the upper member pivoting around the pivot axis between a use position wherein the lower surface of the upper member is adjacent the upper surface of the base and a storage position wherein the lower surface of the upper member is pivoted away from the upper surface of the base, the upper member having a pivot portion with an aperture defined therethru, the aperture receiving the mid section of the pivot shaft;

a first damping element disposed between the shaft and the base, the first damping element comprising two spaced-apart elastomeric rings disposed in the fore aperture of the base and surrounding the fore section of the pivot shaft;

a second damping element disposed between the upper member and the base, the second damping element being at least one elastomeric ring disposed between the pivot portion and one of the supports; and a retaining assembly operable to selectively retain the upper member in at least the use and storage positions with respect to the base, the retaining assembly including a spring loaded ball engaging the detents in the aft section of the pivot shaft when the upper portion is in the use and storage positions.

2. A pivoting mount in accordance with claim 1, wherein:

the base includes a quick release clamping mechanism operable to engage a rail of a weapon, the mechanism defining the lower surface of the base.

3. A pivoting mount in accordance with claim 1, wherein:

the first damping element further including a spacer disposed between the two spaced-apart elastomeric rings.

4. A pivoting mount in accordance with claim 1, wherein:

the at least one elastomeric ring of the second damping element comprises two elastomeric rings, one of the rings being disposed between the fore support and the pivot portion and the other of the rings being disposed between the aft support and the pivot portion, each of the rings being disposed around the pivot shaft.

5. A pivoting mount in accordance with claim 1, wherein:

the base has a recess defined therein, the recess extending from the aperture in the support; and the spring loaded ball is disposed in the recess.

6. A pivoting mount in accordance with claim 1, wherein:

the pivot shaft fixedly engages the pivot portion of the upper member such that the upper member and pivot shaft rotate together.

7. A pivoting mount in accordance with claim 1, wherein:

the pivot portion of the upper member further includes a stop flange defined thereon, the stop flange engaging the base when the upper member is in the storage position.

8. A pivoting mount in accordance with claim 1, wherein:

each of the supports extends upwardly from the upper surface of the base.

9. A pivoting mount for a weapon accessory, comprising a base configured to attach to a weapon;

an upper member;

a pivot shaft having a fore section and an aft section, the pivot shaft pivotally securing the upper member to the base such that the upper member pivots between a use position and a storage position; and a first damping element disposed between the shaft and the base; and a second damping element disposed between the upper member and the base, the second damping element comprising two elastomeric rings, one of the rings being disposed around the fore section of the pivot shaft and the other of the rings being disposed around the aft section of the pivot shaft.

10. A pivoting mount in accordance with claim 9, wherein:

the base has a fore support receiving the fore section of the pivot shaft and an aft support receiving the aft section of the pivot shaft, the supports each having an aperture defined therethru, the apertures being aligned along a fore-aft pivot axis;

the upper member having a pivot portion with an aperture defined therethru, the aperture receiving the mid section of the pivot shaft; and one of the rings being disposed between the fore support and the pivot portion and the other of the rings being disposed between the aft support and the pivot portion.

11. A pivoting mount in accordance with claim 9, wherein:

the base has a fore support receiving the fore section of the pivot shaft and an aft support receiving the aft section of the pivot shaft, the supports each having an aperture defined therethru, the apertures being aligned along a fore-aft pivot axis;

the upper member having a pivot portion with an aperture defined therethru, the aperture receiving the mid section of the pivot shaft; and the first damping element comprises at least one elastomeric ring disposed in one of the apertures of the base and surrounding the pivot shaft.

12. A pivoting mount in accordance with claim 11, wherein:

the at least one elastomeric ring of the first damping element comprises two elastomeric rings disposed in the fore aperture of the base and surrounding the fore section of the pivot shaft; and the first damping element further including a spacer disposed between the two elastomeric rings.

13. A pivoting mount in accordance with claim 9, further comprising:

a retaining assembly operable to selectively retain the upper member in at least the use and storage orientations with respect to the base, the retaining assembly including a spring loaded ball engaging the detents in the pivot shaft when the upper portion is in the use and storage orientations.

14. A pivoting mount in accordance with claim 9, wherein:

the base includes a quick release clamping mechanism operable to engage a rail of a weapon, the mechanism defining the lower surface of the base.

15. A pivoting mount for a weapon accessory, comprising a base configured to attach to a weapon, the base having a lower surface and an upper surface, the lower surface configured to engage the weapon;

an upper member having an upper surface for receiving an accessory and an opposed lower surface;

one of the base or upper member having a fore support and an aft support, and the other of the base or upper member having a mid support, the fore support, aft support and mid support each having an aperture defined therethru, the apertures being aligned along a fore-aft pivot axis;

a pivot shaft engaging the apertures in the supports of the base and upper member such that the pivot shaft extends along the pivot axis, the pivot shaft having an aft section engaging the aft support, a fore section engaging the fore support and a mid section engaging the mid support;

the upper member pivoting around the pivot axis between a use position wherein the lower surface of the upper member is adjacent the upper surface of the base and a storage position wherein the lower surface of the upper member is pivoted away from the upper surface of the base; and a first damping element disposed between the shaft and the base.

16. A pivoting mount for a weapon accessory, comprising a base configured to attach to a weapon;

an upper member;

a pivot shaft pivotally securing the upper member to the base such that the upper member pivots between a use position and a storage position; and a first damping element disposed between the shaft and the base, the first damping element comprising two spaced-apart elastomeric rings; and a second damping element disposed between the upper member and the base.

17. A pivoting mount in accordance with claim 16, wherein:

the two elastomeric rings are disposed in a fore aperture of the base and surround a fore section of the pivot shaft; and the first damping element further includes a spacer disposed between the two spaced-apart elastomeric rings.

* * * * *